United States Patent [19]

Hild

[11] Patent Number: 4,818,223

[45] Date of Patent: Apr. 4, 1989

[54] APPARATUS FOR TREATING WORKPIECES WITH HOT GASES INCLUDING GAS DISTRIBUTING MEANS

[75] Inventor: Gerhard Hild, Asslar, Fed. Rep. of Germany

[73] Assignee: Arthur Pfeiffer Vakuumtechnik Wetzlar GmbH, Asslar, Fed. Rep. of Germany

[21] Appl. No.: 64,221

[22] Filed: Jun. 18, 1987

[30] Foreign Application Priority Data

Jul. 3, 1986 [DE] Fed. Rep. of Germany ..... 3622339

[51] Int. Cl.[4] ..... F27B 5/04

[52] U.S. Cl. ..... 432/205; 137/876; 137/887; 251/368

[58] Field of Search ..... 432/200, 203, 205; 137/876, 887; 251/368

[56] References Cited

U.S. PATENT DOCUMENTS

| | | | |
|---|---|---|---|
| 3,837,356 | 9/1974 | Selep et al. | 251/368 X |
| 4,134,427 | 1/1979 | Vitner | 137/876 |
| 4,162,141 | 7/1979 | West | 432/200 X |
| 4,311,166 | 1/1982 | De Feo | 251/368 X |
| 4,348,116 | 9/1982 | Bordas | 137/876 X |
| 4,403,626 | 9/1983 | Paul, Jr. | 137/887 X |
| 4,596,526 | 6/1986 | Soliman | 432/205 X |
| 4,697,615 | 10/1987 | Tsuchimato et al. | 137/375 X |

*Primary Examiner*—Steven E. Warner

*Attorney, Agent, or Firm*—Toren, McGeady & Associates

[57] ABSTRACT

Apparatus for treating workpieces under the action of hot gases within a chamber in order to achieve as homogeneous a treatment or processing as possible are provided with a valve mechanism whereby the gas is made to flow alternately from one side to the other over objects or workpieces within the chamber, the valve mechanism being especially designed to operate with heated gases and serving to reverse the gas flow.

10 Claims, 2 Drawing Sheets

APPARATUS FOR TREATING WORKPIECES WITH HOT GASES INCLUDING GAS DISTRIBUTING MEANS

BACKGROUND OF THE INVENTION

1. Field of the Invention

The present invention is directed particularly to apparatus for treating workpieces in a chamber under the action of a hot gas, and, more particularly, to a device including valve means for distributing the flow of the hot gases.

2. Description of Related Art

In devices of the type to which the present invention relates, charges or batches are processed in a chamber under the action of a hot gas which is supplied to the charge by a special inlet device. In such apparatus, a chamber is provided which may be subjected to overpressure or underpressure.

In the art to which the present invention relates, a charge or workpiece can be subjected to a heat treatment and/or a chemical treatment by exposing the charge or workpiece to the action of heated gases. On the one hand, this can be accomplished by placing the charge into a heat treatment furnace within which a static gas atmosphere is heated. Alternatively, the charge can be exposed to a constant hot gas flow produced within the chamber by means of suitable inlet and outlet apertures.

Installations of this type are known in which a heat treatment furnace is equipped with a system of gas inlet and gas outlet apertures. Initially, the gas is heated by a gas preheater and then introduced from one side and it is thus directed to the charge which is to be treated. The gas then exits again on the opposite side and so as to achieve a better distribution of gas flow, the gas inlet system may be located in the center of the furnace.

In that case, gas will flow from the center symmetrically toward both sides over the charge or batch being treated and will then be exhausted at the opposite side.

Such processes have the disadvantage that homogeneous distribution of gas cannot be satisfactorily accomplished. Apart from that, there results directed gas flows which give rise to an interference factor and, thus, are undesirable. In particular, in numerous chemical processes, a homogeneous circulation of the charge on all sides by the gas participating in the reaction is of considerable importance.

SUMMARY OF THE INVENTION

The invention is thus directed toward providing an apparatus with which it is possible to direct hot gas flow in a heat treatment furnace in such a way that homogeneousness of gas distribution over a charge or workpiece is improved and, on average, no directed gas flow is produced.

Briefly, the present invention may be described as apparatus for processing workpieces under the action of hot gases, in which, in a chamber, a heating device containing the objects to be processed, and a connection for evacuating or subjecting the chamber to overpressure are arranged, the apparatus being particularly characterized in that there is present in the chamber within the heating device at least one hot gas valve designed as a three-way valve for supplying the gas.

In accordance with a more detailed aspect of the invention, there is additionally present in the chamber at least one hot gas valve for carrying the gas away and preferably there may be present in the chamber several hot gas valves designed as three-way valves for supplying and carrying away the gas. A three-way valve for controlling the hot gas flow within the chamber may consist of a housing with a gas inlet stub and two gas outlet stubs, one valve core which is arranged to be rotatable within the housing and which is equipped on the gas inlet side with two apertures and on the gas outlet side with one aperture and with a rotational pin by means of which the position of the valve core with respect to the housing can be changed in such a manner that the gas inlet stub is alternately connected with one of two gas outlet stubs. The valve means of the invention are particularly characterized in that the housing and the valve core consist of metal, preferably heat resistant steel or molybdenum, which is suitable for operation at temperatures exceeding 1000° C., wherein the outer surface of the valve core is equipped with a layer of ceramic material.

In accordance with a more detailed aspect of the invention, the outer surface of the valve core may comprise a layer of wear resistant material, such as, for example, a metal oxide or metal nitride.

Additionally, the valve core may consist entirely of ceramic material.

In accordance with the invention, it is possible that the hot gas flow may be reversed in such a way in the heating device within the chamber that it alternately flows through or around the charge from one side or the other. Thus, on average, a directed gas flow is avoided and adequate homogeneousness of the gas distribution is assured.

Since the flowing gases must be previously heated, a gas preheater is located within the chamber as well as one or several suitable hot gas valves, which control the gas flow. The hot gas valves are designed as three-way valves and are particularly suited to be operated at high temperatures, i.e., 1000° C. to 1800° C. In conventional valves of this type, operation at these temperatures is not possible since the valve core and the valve head come in contact and may be welded together at high temperature. In order to prevent this, it is provided in accordance with the present invention that the outer surface of the valve core be equipped with a ceramic layer or with another wear resistant layer. The valve directs the hot gas flow respectively to one or another gas inlet aperture.

The various features of novelty which characterize the invention are pointed out with particularity in the claims annexed to and forming a part of this disclosure. For a better understanding of the invention, its operating advantages and specific objectives attained by its use, reference should be had to the drawings and descriptive matter in which there is illustrated and described a preferred embodiment of the invention.

DETAILED DESCRIPTION OF THE PREFERRED EMBODIMENT

Figure 1:
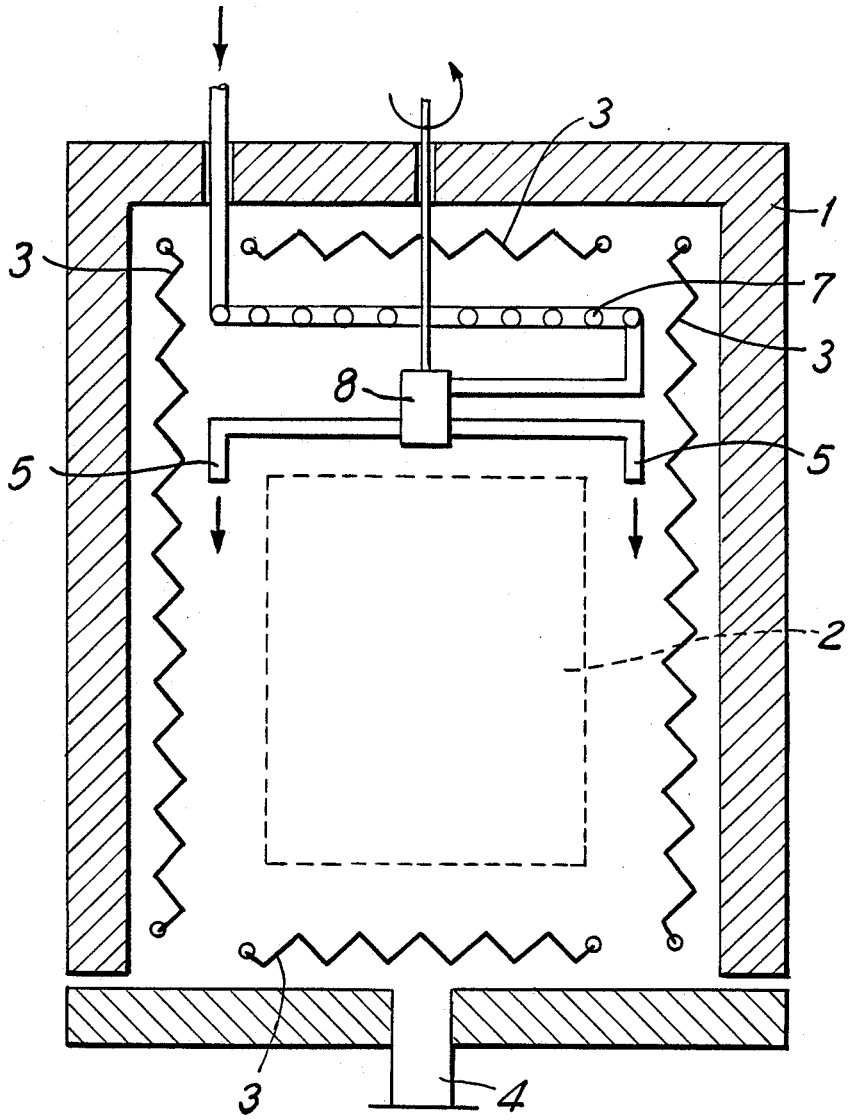
FIG. 1 is a schematic cross-sectional view of an apparatus in accordance with the invention.

Referring now to the drawings and particularly to FIG. 1, there is shown apparatus in accordance with the present invention which comprises a device for treating a charge or a workpiece with hot gases. Referring to FIG. 1, the apparatus includes a chamber 1 in which a charge 2 is placed for processing under the action of hot gas. The interior space of the chamber 1 is brought up to the temperature characteristic for treatment of the charge by means of a heating device 3. The chamber 1 may be selectively evacuated or subjected to pressure through a connection or conduit 4.

Gas inlet apertures 5 are located within the chamber 1 and the gas which is admitted is heated by a gas preheater 7.

A three-way valve 8 operates to distribute the gas flow entering the chamber 1. The three-way valve 8 is structured in accordance with the present invention in a manner which will be described more fully hereinafter with reference to FIG. 2. However, it should be noted that the valve 8 is made with a special structure because it is operated inside of the heating device 3 and because hot gas flows therethrough. The valve 8 is actuated in such a manner that hot gas flows around the charge 2 alternately from the left-hand side and once from the right-hand side. Gas exhaust apertures and additional three-way valves for carrying the gas away can be provided to correspond with the gas inlet openings 5 and the three-way valve 8. Furthermore, the control of the gas inlet and the gas outlet can occur by means of a system of several valves.

Figure 2:
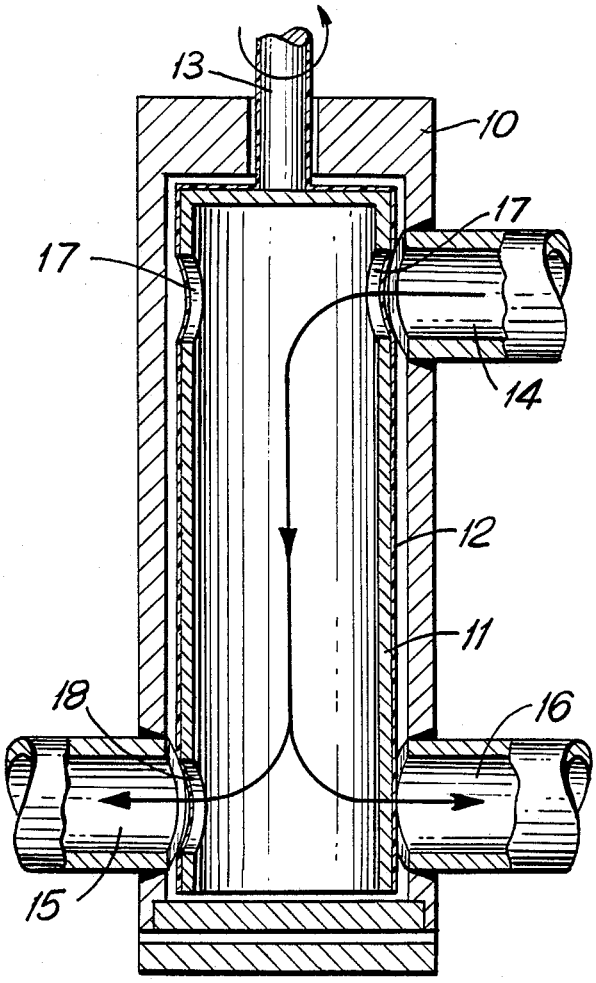
FIG. 2 is a cross-sectional view of the hot gas valve means of FIG. 1.

FIG. 2 shows in more detail the structure of the hot gas valve 8. A gas inlet stub 14 and two gas outlet stubs 15 and 16 are attached to a housing 10 of the valve assembly 8. A valve core 11 is located within the housing 10 and the valve core 11 is provided with two apertures 17 on the gas inlet side and one aperture 18 on the gas outlet side. Therefore, it will be noted that the core 11 is essentially provided with two gas inlet apertures 17 and one gas outlet aperture 18.

The valve core 11 is rotated by means of a rotational pin 13, whereby it may be brought into positions in which the gas inlet stub 14 is in flow communication with either of the two gas outlet stubs 15 or 16. That is, as will be clear from FIG. 2, by rotating the pin 13 and the housing 11, the gas outlet aperture 18 may be brought into flow communication selectively with either the gas outlet stub 15 or the gas outlet stub 16. Since, in either position of the core 11, one of the two apertures 17 will be in flow communication with the gas inlet stub 14, flow communication between the stub 14 and either of the stubs 15 and 16 may be alternately selectively effected.

The housing 10 and the valve core 11 are preferably fabricated from a heat resistant steel or molybdenum which is suitable for operating at high temperatures in excess of 1000° C. In addition the external surface of the valve core 11 is provided with a coating 12 made from ceramic material.

By way of an additional embodiment of the present invention, the external surface of the valve core 11 may be provided with another wear resistant layer, for example, preferably a metal oxide or a metal nitride or the metal core 11 may be made entirely out of ceramic material.

Thus, from the foregoing, it will be seen that the present invention provides an apparatus in which objects or charges may be processed under the action of hot gases in a chamber. In order to achieve as homogeneous a treatment or processing of the charge as possible, the gas is made to flow alternately over different sides of the objects or charge so that the gas is directed from one or the other side into the chamber. A valve mechanism designed especially to operate with heated gases in accordance with the invention serves for reversing the gas flow.

While a specific embodiment of the invention has been shown and described in detail to illustrate the application of the inventive principles, it will be understood that the invention may be embodied otherwise without departing from such principles.

What is claimed is:

1. Apparatus for processing objects under the action of hot gas, wherein, in a chamber, a heating device containing the objects to be processed and a connection for evacuating or subjecting the chamber to overpressure are arranged, comprising the improvement that there is present in the chamber within said heating device at least one hot gas valve designed as a three-way valve for supplying the hot gas, wherein said three-way valve comprises a housing having a gas inlet stub and two gas outlet stubs, one valve core which is arranged to be rotatable within said housing and is equipped on a gas inlet side with two apertures and on a gas outlet side with one aperture and with a rotational pin by means of which the position of said valve core with respect to said housing can be changed in such a manner that said gas inlet stub is alternately connected with either of said two gas outlet stubs, said housing and said valve core consisting essentially of metal which is suitable for operation at temperature in excess of 1,000° C. with the outer surface of said valve core being equipped with a layer of ceramic material.

2. Apparatus according to claim 1, wherein said metal is a heat resistant steel.

3. Apparatus according to claim 1, wherein said metal is a heat resistant molybdenum.

4. Apparatus according to claim 1, wherein said valve core consists entirely of ceramic material.

5. Apparatus according to claim 1, wherein the outer surface of said valve core is provided with a layer of wear resistant material.

6. Apparatus according to claim 5, wherein said wear resistant material is a metal oxide.

7. Apparatus according to claim 5, wherein said wear resistant material is a metal nitride.

8. A three-way valve for control of hot gas flow, comprising a housing having a gas inlet stub and two gas outlet stubs, one valve core which is arranged to be rotatable within said housing and is equipped on a gas inlet side with two apertures and on a gas outlet side with one aperture and with a rotational pin by means of which the position of said valve core with respect to said housing can be changed in such a manner that said gas inlet stub is alternately placed in flow communication with either one of said two gas outlet stubs, said housing and said valve core consisting of a metal which is suitable for operation at temperatures in excess of 1000° C. with the outer surface of said valve core being equipped with a layer of ceramic material.

9. A valve according to claim 8, wherein said metal is a heat resistant steel.

10. A valve according to claim 8, wherein said metal is heat resistant molybdenum.

* * * * *